United States Patent [19]

Harbison et al.

[11] Patent Number: 4,892,808

[45] Date of Patent: Jan. 9, 1990

[54] PHOTOGRAPHIC MATERIAL PROTECTED AGAINST HYDROGEN CYANIDE GAS

[75] Inventors: Kenneth G. Harbison, Rochester; Wilbur S. Gaugh, Webster, both of N.Y.

[73] Assignee: Eastman Kodak Company, Rochester, N.Y.

[21] Appl. No.: 352,322

[22] Filed: May 12, 1989

Related U.S. Application Data

[63] Continuation-in-part of Ser. No. 208,911, Jun. 20, 1988, abandoned.

[51] Int. Cl.[4] ..... G03C 1/06

[52] U.S. Cl. ..... 430/517; 430/220; 430/607; 430/608; 430/612

[58] Field of Search ..... 430/220, 517, 607, 608, 430/612

[56] References Cited

U.S. PATENT DOCUMENTS 2,566,245 8/1951 Trivelli et al. .
2,566,263 8/1951 Trivelli et al. .
3,900,323 8/1975 MacLeish et al. .

*Primary Examiner*—Paul R. Michl
*Assistant Examiner*—Janet C. Baxter
*Attorney, Agent, or Firm*—Joshua G. Levitt

[57] ABSTRACT

A silver halide emulsion contained in a photographic element is protected against hydrogen cyanide gas, which may evolve from carbon black contained in a non-light sensitive material associated with the photographic element, by a scavenger for hydrogen cyanide gas in a location where it will intercept the hydrogen cyanide gas.

12 Claims, No Drawings

PHOTOGRAPHIC MATERIAL PROTECTED AGAINST HYDROGEN CYANIDE GAS

This application is a continuation-in-part of our U.S. application Ser. No. 208,911, filed June 20, 1988, now abandoned.

FIELD OF INVENTION

This invention relates to silver halide photographic elements which are associated with non-light sensitive materials containing carbon black.

BACKGROUND OF THE INVENTION

Silver halide photographic materials are light sensitive. Prior to exposure and development they must be protected agaist unintended exposure to light. Carbon black is a common opacifying agent that is incorporated in or coated on a support and associated with photographic materials containing silver halide in order to protect them from unwanted exposure. The opaque support can be non-light sensitive and associated with the silver halide element as a packaged material for sheets or rolls of photographic material, or as a backing material.

A backing material is an opaque sheet placed on the side of a photographic element opposite the side bearing the silver halide emulsion layer. Unlike a packaging material, the backing material remains associated with the photographic element while it is being exposed. Its principal function is to carry indicia regarding the photographic element which are viewable through the back of a camera, and at the same time protect the photographic element from exposure to light entering through light transmissive portions of the back of the camera.

A problem has been observed recently with uniform fog occurring in photographic elements which have a backing material associated with them. This has been observed in particular with color photographic elements containing silver halide emulsion layers which have been sensitized with sulfur and gold.

The present invention is based on the discovery of the origin of and means for reducing this objectionable fog.

We have found that the fog is caused by hydrogen cyanide gas which evolves from the carbon in an associated backing material. We believe the mechanism which occurs is that hydrogen cyanide gas evolves from the carbon and migrates to the silver halide emulsion where it binds with the gold in sulfur and gold sensitized silver halide grains. This leaves silver sulfide fog centers which lead to development of unexposed silver halide grains upon processing.

As a consequence of these discoveries, we have recognized that the objectionable fog can be eliminatd by incorporation of a scavenger for hydrogen cyanide gas in the backing material. It will be recognized that while the description hereinafter refers to backing materials, carbon contained in packaging materials, or in other non-light sensitive materials associated with a silver halide photographic element, could also cause a fog problem, and that the fog would be eliminated by applying to these other materials the same solution as is applied to backing materials.

It has been suggested in U.S. Pat. No. 3,900,323 that certain heavy metal salts can be added to backing or antihalation layers of photosensitive elements containing carbon black in order to inhibit fog formation attributed to sulfur or sulfur containing compounds associated with the carbon black. This patent does not suggest the need to scavenge hydrogen cyanide gas or the effectiveness of the scavengers of this invention in the amounts in which they are employed.

In accordance with the present invention there is provided a photographic assemblage comprising a light-sensitive photographic element comprising a support bearing a silver halide emulsion layer and an associated non-light sensitive material comprising a support containing carbon black, the assemblage containing, as a scavenger for hydrogen cyanide gas in a location where it can intercept hydrogen cyanide gas evolving from carbon black in the associated material before the gas reaches the silver halide in the light-sensitive element, a noble metal compound selected from the group consisting of palladium, gold, platinum, in an amount of about 1 to 250 parts metal per million parts carbon black by weight or a noble metal compound selected from the group consisting of iridium, rhodium and osmium in an amount of about 10 to 1,000 parts metal per million parts carbon black by weight.

It is believed that the heavy metal scavenger compound binds with hydrogen cyanide gas to form a photographically inert material. The scavenger either should not itself have a deleterious effect on silver halide or should be incorporated in such a manner that it does not come into contact with the silver halide layers. It should not release a material as a result of scavenging cyanide gas which would have a deleterious effect on the silver halide material. Suitable scavengers for cyanide gas can be selected from inorganic or organic compounds of noble metals. Especially preferred are compounds of palladium (II or IV), platinum (II or IV), and gold (I or III). Compounds of rhodium (III), iridium (III or IV), and osmium (II, III or IV) are also effective, but are less preferred because of the higher amount needed to obtain equivalent protection.

Typical useful compounds include potassium tetrachloropalladate (II), potassium hexachloropalladate (IV), palladium (II) chloride, palladium (II) acetate, potassium tetrachloroplatinate (II), rhodium (III) chloride, potassium tetrachloroaurate (III), potassium hexachloroplatinte (IV), palladium (II) tetraamine dichloride, potassium hexachloroiridate (IV), potassium tetrachloroiridate (III), and potassium hexachloroosmate (IV).

The scavenger materials are commercially available and should be used in a degree of purity which would not deleteriously affect the photographic material. Depending upon the location of the scavenger material, differing degrees of purity can be used.

Trivelli and Smith U.S. Pat. Nos. 2,566,245 and 2,566,263 describe the use of certain compounds of palladium, platinum, iridium, and rhodium as fog-inhibiting compounds for silver halide emulsions to improve keeping under high humidity and high temperature conditions, as in tropical regions. These patents describe the use of certain noble metal salts as addenda to the silver halide emulsion before coating, either before digestion of the silver halide, before spectral sensitization, or after spectral sensitization. They also describe their use in a layer contiguous or adjacent to, or in contact with the silver halide emulsion layer. There is no suggestion in these patents that the fog is caused by cyanide, nor that the noble metal salts specified might protect from cyanide from sources outside the emulsion, nor that the salts might be effective if not contained in the emulsion layer or an adjacent layer.

In the present invention, the scavenger material preferred is located in a position close to the source of the cyanide gas, although it can be located at a more remote location, so long as it can intercept cyanide gas before it reaches the silver halide emulsion. Thus, it can be located in the layer that contains the carbon black, it can be located in a layer coated over the layer containing the carbon black, it can be coated in a layer on the opposite side of the support from the carbon black layer or it can be located in a layer of the photographic element remote from the silver halide emulsion layer.

The amount ofpscavenger will depend upon the efficacy of the particular scavenger employed, the location in which it is placed, the type of carbon which is used, the amount of cyanide which is expected to evolve from the carbon and the proportion of evolved cyanide which is desirably intercepted. Expressed in terms of parts metal per million parts carbon black, the more effective scavengers, such as platinum, palladium and gold, are employed in an amount of about 1 to 250 parts metal per million parts carbon by weight. Preferred are amounts of about 5 to 70 ppm metal and especially preferred are 5 to 25 ppm metal. The less effective scavengers, such as iridium, rhodium and osmium are employed in amounts of about 10 to 1000 parts metal per million parts carbon, by weight. Especially preferred are amounts of about 100 to 1000 ppm metal.

The carbon with which the present invention can be employed is any carbon black which can be used as an opacifying material in photographic backing and packaging materials. We have determined that the amount of cyanide evolved from a carbon black varies depending upon the conditions under which the carbon black was prepared. Thus, the more cyanide gas which can evolve from a carbon black the greater the need for our invention. Examples of such carbon blacks are furnace blacks, lamp blacks, and channel blacks. Among those with which our invention can be used, are carbon blacks sold under such trademarks as Neotex and Raven by Columbian Chemicals Company, Swartz, La. 71281 and under such trademarks as Monarch, Regal and Black Pearl by Cabot Corporation, Boston, Mass. 02110.

The backing or packaging material can be a simple element comprising a support in which is incorporated the carbon black, or which bears one or more layers of carbon black. It can, however, contain additional layers such as overcoat layers and a layer or layers which contain printed information. One or more carbon black layers can be employed.

The support is a planar material, typically a paper support or a "synthetic" paper support composed of a polymer intended to simulate paper. However, the support can be composed of a film of polyester or polyolefin. The support should have the requisite flexibility to serve its intended function as a backing or packaging material.

The carbon black layer will comprise carbon black dispersed in a binder. Useful binders include naturally occurring polymeric vehicles such as gelatin and cellulose derivatives and synthetic vehicles such as polyvinyl alcohol and its derivatives, acrylate and methacrylate polymers, butadiene-styrene polymers and similar materials. The various layers of the element can contain other components such as surfactants, dispersing aids, coating aids, other pigments, and the like.

When the scavenger for cyanide gas is incorporated in the carbon black layer it conveniently will be dispersed in the same binder as is employed for the carbon black. If it is employed in another layer, such as an overcoat layer, it can be dispersed in any useful binder, such as those enumerated above, which would be compatible with the adjacent layers. Alternatively, it can be applied without a binder from an aqueous or organic solvent.

The photographic element with which the backing or packaging material is associated can be any photographic element known in the art. It can be a simple element comprising a support bearing a layer of a silver halide emulsion. In normal practice it will be more complex. The photographic element can be a black and white element intended for amateur or professional use, including radiographic use, or it can be a color photographic material intended to form a color negative image or a color positive image.

As indicated above, the present invention is particularly useful in reducing fog formation in silver halide emulsions which are sensitized with gold, such as sulfur and gold, selenium and gold, etc. Such sensitization is described in more detail in U.S. Pat. Nos. 2,743,182 and 3,297,447, the disclosures of which are incorporated herein by reference.

The photographic materials will commonly be spectrally sensitized with a spectral sensitizing dye. The color photographic elements will have multiple layers which are sensitive to different regions of the visible spectrum and commonly will have associated with each a color former, such as a dye-forming coupler, that will provide a viewable dye image.

Further details of such materials can be found in *Research Disclosure,* December 1978, item 17643, which relates to photographic silver halide emulsions, preparations, addenda, processing and systems; *Research Disclosure,* November 1979, item 18716, which relates to reflection color print materials; and *Research Disclosure,* August 1979, items 18431, which relates to radiographic materials. *Research Disclosure* is published by Industrial Opportunities Ltd., Homewell, Havant, Hampshire P09 1EF UK.

In the following examples, which further illustrate this invention, the following Standard Test Procedure was employed:

Backing and packaging materials were evaluated by the amount of fog induced in a color negative film containing sulfur and gold sensitized silver halide emulsions when the film was left in contact with the material. The film employed contains a sulfur and gold sensitized silver bromoiodide emulsion and is sold under the trademark Kodacolor VRG 100. When exposed to hydrogen cyanide, fog is exhibited first in one of the green-sensitive layers. It appears as an increase in green minimum density ($D_{min}$). As the amount of hydrogen cyanide increases, fog is exhibited in other layers. The standard test procedures used is as follows:

A paper sample was cut into two strips 3.5 cm by 30 cm. These were maintained for one hour at 50% relative humidity and 25° C. The strips were placed one on each side of a 3.5 cm by 30 cm strip of the film sample, and sealed in an aluminum foil bag lined with polyethylene. The sealed bag was maintained at 49° C. and 50% relative humidity for seven days, after which the film was processed (without exposure) in the Kodacolor C41 process, the details of which are described in the British Journal of Photography Annual, 1977, pp.

201–205. The amount of fog was determined from the difference in green density between the film incubated with the test paper and that of a piece of film incubated under the same conditions without the paper.

EXAMPLE 1

A black paper having a basis weight of 68 g/m$^2$ and containing 4.8 g/m$^2$ of a medium flow furnace black (REGAL 400R TM, produced and sold by Cabot Corporation, Boston, Mass. 02110) was printed on one side with indicia. This side was coated with an ethanol solution of an alcohol-soluble cellulose butyrate polymer at a coverage of 2.4 g/m$^2$ of polymer. The other side of the paper was coated, in two layers, with a carbon-containing styrene-butadiene latex at a total coverage of 15 g/m$^2$ of polymer and 8.4 g/m$^2$ of carbon. The carbon was a high abrasion furnace carbon (NEOTEX 326 TM, produced and sold by Columbian Chemicals Co., Swartz, La. 71281). This surface was overcoated with an ethanol solution of ethyl cellulose and potassium tetrachloropalladate (II) to provide a coverage of 1.1 g/m$^2$ of ethyl cellulose and 0.27 mg/m$^2$ palladium, corresponding to 20 ppm with respect to total carbon. In use, the side of the backing paper opposite the side with the printed indicia is placed adjacent the support side of the film. When this paper was submitted to the Standard Test Procedure described above, the green minimum density of the film was 0.004 units less than a film with no backing paper, whereas a control backing paper prepared and tested in an identical manner, except for omission of the palladium compound from the overcoat, had a green minimum density of +0.028 units greater than the film with no backing paper.

EXAMPLE 2

White paper with a basis weight 68 g/m$^2$ was coated on one side with calcium carbonate and a yellow pigment in a alcohol-soluble cellulose butyrate binder at a total coverage of 4.1 g/m$^2$. This was printed on the same side with indicia and overcoated with an ethanol solution of an alcohol-soluble cellulose butyrate at a coverage of 2.4 g/m$^2$ polymer. The other side of the paper was coated with a carbon-containing styrene-butadiene latex at a coverage of 15 g/m$^2$ polymer and 8.4 gm$^2$ carbon. The carbon was NEOTEX 326 TM. To the carbon-containing latex had been added compounds of noble metals shown in Table 1, below, at the concentrations shown expressed as parts metal per million parts carbon. Each of the papers was submitted to the Standard Test Procedure described above. The fog induced by these coatings is summarized in Table 1 as a change in green $D_{min}$ relative to no paper. From this data, it will be seen that each of the compounds was effective in reducing fog, the most effective being compounds of palladium, platinum and gold.

TABLE 1

| Compound Added | Metal, ppm Carbon | Metal mg/m$_2$ | Change in Green $D_{min}$ |
|---|---|---|---|
| None | — | — | 0.026 |
| $K_2PdCl_4$ | 65 | 0.55 | 0.000 |
| $Pd(OAc)_2$ | 65 | 0.55 | 0.002 |
| $Pd(NH_3)_4Cl_2$ | 65 | 0.55 | 0.000 |
| $K_2PdCl_6$ | 65 | 0.55 | −0.001 |
| $K_2PtCl_4$ | 65 | 0.55 | 0.001 |
| $K_2PtCl_6$ | 65 | 0.55 | 0.000 |
| $KAuCl_4$ | 65 | 0.55 | −0.001 |
| $KIrCl_4$ | 65 | 0.55 | 0.022 |
| $K_2IrCl_6$ | 65 | 0.55 | 0.011 |
| $K_2IrCl_6$ | 330 | 2.8 | 0.001 |

TABLE 1-continued

| Compound Added | Metal, ppm Carbon | Metal mg/m$_2$ | Change in Green $D_{min}$ |
|---|---|---|---|
| $RhCl_3$ | 65 | 0.55 | 0.011 |
| $K_2OsCl_6$ | 65 | 0.55 | 0.018 |

EXAMPLE 3

A packaging paper comprising a paper support containing 7.5 g/m$^2$ of a medium flow furnace carbon (REGAL 400R TM) was treated with an aqueous solution of potassium tetrachloropalladate (II) to provide a coverage of 0.58 mg/m$^2$ palladium. This paper was coated with the control carbon-containing latex as in Example 2. The amount of palladium corresponds to 36 ppm with respect to total carbon. When the paper was submitted to the Standard Test Procedure, there was an increase in green $D_{min}$ of 0.006 relative to no paper whereas film tested with an untreated packaging paper under the same conditions showed an increase in green minimum density of 0.057 relative to no paper. This is a significant improvement over the control papers which did not have the palladium compound imbibed into the paper support.

EXAMPLE 4

Example 2 was repeated except that the paper had a weight of 56 gm/m$^2$; potassium tetrachloropalladate (II) was used at a coverage of 0.27 mg/m$^2$, as palladium (32 ppm); and the carbon containing side was overcoated with an ethanol solution of ethyl cellulose to provide a coverage of 1.1 g/m$^2$ of polymer. When submitted to the Standard Test Procedure there was a decrease in green $D_{min}$ of 0.002 relative to no paper, while a control paper which was identical except from the omission palladium gave an increase in green $D_{min}$ of 0.025 relative to no paper.

EXAMPLE 5

Backing papers were prepared with various mixtures of two carbons; one, a tinting carbon (Raven 1020 TM, produced and sold by Columbian Chemicals Co., Swartz, La.) containing a high concentration (22.0 mg/kg) of cyanide and the other, a high abrasion furnace carbon (NEOTEX 326 TM) containing a relatively low concentration (0.7 mg/kg) of cyanide. The papers had the structure and concentration of components described in Example 2 except that the styrene-butadiene latex contained a mixture of the two carbons at a coverage of 8.4 g/m$^2$ and in proportions that would provide the cyanide (CN) concentration shown in Table 2, below. Potassium tetrachloropalladate (II) had been added to the carbon-containing latex in amounts such that the coatings contained 0, 0.11, or 0.28 mg/m$^2$ of palladium (0, 13 and 33 ppm with respect to total carbon). The fog induced by these coatings was measured as described in the Standard Test procedure above, and is reported in Table 2. These data show that there is a correlation between the level of cyanide in the carbon and the amount of fog induced in the film and that presence of the palladium compound reduces the amount of fog.

TABLE 2

| Paper No. | CN in Carbon mg/kg | D min no Pd | Change in Green D min 0.11 mg/m$^2$ Pd (13 ppm) | Change in Green D min 0.28 mg/m$^2$ Pd (33 ppm) |
|---|---|---|---|---|
| 1 | 0.7 | 0.003 | −0.001 | −0.003 |
| 2 | 1.7 | 0.015 | −0.001 | −0.002 |
| 3 | 2.4 | 0.020 | 0.003 | −0.002 |
| 4 | 3.5 | 0.030 | 0.000 | −0.001 |
| 5 | 5.3 | 0.055 | 0.003 | −0.001 |
| 6 | 8.4 | 0.066 | 0.012 | −0.002 |
| 7 | 13.5 | 0.115 | 0.053 | 0.005 |
| 8 | 22.0 | 0.162 | 0.115 | 0.035 |

EXAMPLE 6

Example 2 was repeated except that the level of potassium tetrachloropalladate (II) per million parts carbon was varied as shown in Table 3, below. It will be observed that the compound was effective at very low levels.

TABLE 3

| Coating | Pd ppm Carbon | Change in Green D min |
|---|---|---|
| 1 | 0 | +.024 |
| 2 | 8 | +.003 |
| 3 | 17 | +.004 |
| 4 | 33 | +.000 |
| 5 | 66 | +.001 |

The invention has been described in detail with reference to preferred embodiments thereof. However, it will be recognized that modifications can be made within the spirit and scope of the invention.

What is claimed is:

1. A photographic assemblage comprising:

(a) a light-sensitive photographic element comprising a support bearing a sulphur and gold sensitized silver halide emulsion layer, and (b) an associated non-light sensitive material comprising a support and carbon black, the assemblage containing, as a scavenger for hydrogen cyanide gas in a location where it will intercept hydrogen cyanide gas evolving from the carbon black before the gas reaches the silver halide in the photosensitive element, a noble metal compound selected from the group consisting of palladium, gold and platinum, in an amount of about 1 to 250 parts metal per million parts carbon black by weight, or a noble metal compound selected from the group consisting of iridium, rhodium and osmium in an amount of about 10 to 1000 parts metal per million parts carbon black, by weight.

2. An assemblage of claim 1 wherein the scavenger is contained in the associated material.

3. An assemblage of claim 2, wherein the associated material is a backing material.

4. An assemblage of claim 2 wherein the scavenger is present in the same layer as the carbon black.

5. An assemblage of claim 2 wherein the scavenger is present in a layer over the carbon black layer.

6. An assemblage of claim 1 where the scavenger is an organic or inorganic palladium, platinum or gold compound.

7. An assemblage of claim 6 wherein the scavenger is an inorganic palladium compound.

8. An assemblage of claim 6 wherein the scavenger is palladium dichloride or potassium tetrachloropalladate (II).

9. An assemblage of any one of claims 6, 7 or 8 wherein the scavenger compound is present in an amount of about 5 to 70 parts metal per million parts carbon black.

10. A photographic assemblage of claim 9 wherein the scavenger compound is present in an amount of 5 to 25 parts metal per million parts carbon black.

11. A photographic assemblage of claim 1, wherein the scavenger is an organic or inorganic iridium, rhodium or osmium compound.

12. A photographic assemblage of claim 11, wherein the scavenger compound is present in an amount of about 100 to 1,000 parts metal per million parts carbon black.

* * * * *